US005628219A

United States Patent [19]

Fink et al.

[11] Patent Number: 5,628,219

[45] Date of Patent: May 13, 1997

[54] DRAWING PROCESS CONTROL METHOD

[75] Inventors: Wolf-Dieter Fink, Preussisch Oldendorf; Gustav Matthies, Barntrup, both of Germany

[73] Assignee: Herborn & Breitenbach GmbH & Co. KG, Unna, Germany

[21] Appl. No.: 418,615

[22] Filed: Apr. 7, 1995

[30] Foreign Application Priority Data

Apr. 9, 1994 [DE] Germany ..... 44 12 268.3

[51] Int. Cl.[6] ..... B21C 1/12

[52] U.S. Cl. ..... 72/17.2; 72/21.4; 72/279; 72/288

[58] Field of Search ..... 72/279, 288, 16.2, 72/16.6, 18.1, 18.4, 17.2, 21.1, 21.4

[56] References Cited

U.S. PATENT DOCUMENTS

| | | | |
|---|---|---|---|
| 2,272,187 | 2/1942 | Dahlstrom | 72/279 |
| 3,798,939 | 3/1974 | Mertens | 72/279 |
| 4,662,203 | 5/1987 | Kanatani | 72/279 |

FOREIGN PATENT DOCUMENTS

| | | | |
|---|---|---|---|
| 12992 | 7/1980 | European Pat. Off. | 72/279 |
| 1072216 | 12/1959 | Germany . | |
| 2140580 | 8/1971 | Germany . | |
| 2749505C2 | 5/1979 | Germany . | |
| 3009779 | 3/1980 | Germany . | |
| 4009732A1 | 3/1990 | Germany . | |

*Primary Examiner*—Daniel C. Crane

*Attorney, Agent, or Firm*—Chilton, Alix & Van Kirk

[57] ABSTRACT

A process for controlling a multiple stage drawing machine that implements a direct non-sliding drawing process provides for set-up and production to be automatic and for the variables necessary for process control, especially material speed and applied force, to be derived without establishing contact between the stock material and a sensing device.

19 Claims, 1 Drawing Sheet

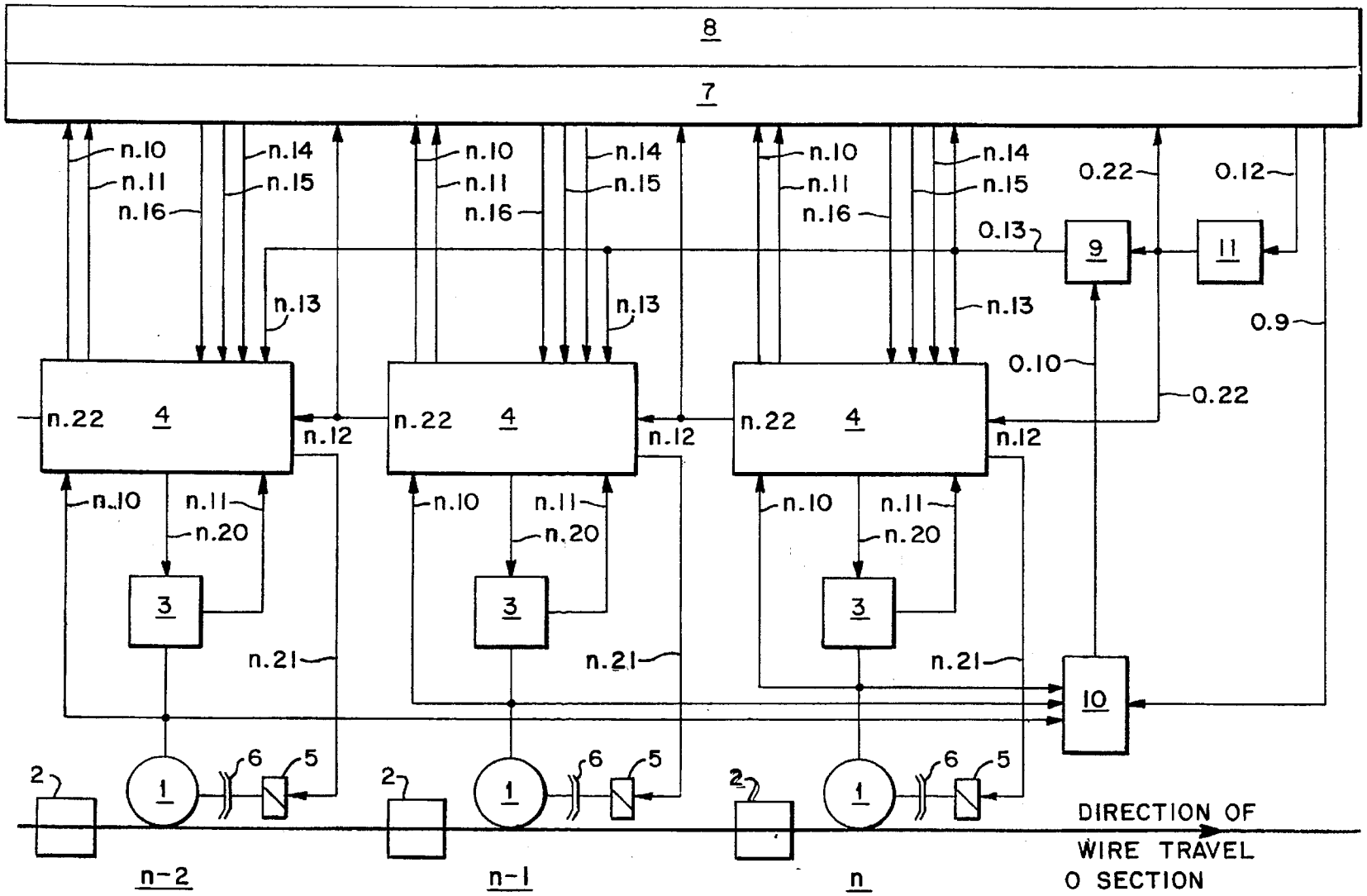
DIRECTION OF
WIRE TRAVEL
O SECTION
n
n-1
n-2
0.9
0.10
0.12
0.13
0.22
n.10
n.11
n.12
n.13
n.14
n.15
n.16
n.20
n.21
n.22

DRAWING PROCESS CONTROL METHOD

BACKGROUND OF THE INVENTION

1. Field of the Invention

The present invention relates to the exercise of control over a multi-stage drawing machine and, particularly, a machine which performs a direct, non-sliding drawing of elongated stock material to form such material into a desired shape. More specifically, this invention is directed to the automatic set-up and subsequent control over the individual drives of a cascaded drawing system wherein stock material is serially pulled through a plurality of stationary dies. Accordingly, the general objects of the present invention are to provide novel and improved methods of such character.

2. Description of the Prior Art

Drawing systems for forming, from elongated stock typically fed from a supply reel, products having a desired cross-sectional size and shape are well known in the art. Such systems are commonly used to produce wire, endless strips and endless sections by a direct, non-sliding or non-slip, straight process without the intervention of cutting tools. The prior art drawing systems are provided with plural drives. These individual drives are typically located immediately downstream of an associated die and are independently adjustable to control the interrelated drawing process parameters of the speed of the stock material relative to the die and the force applied to pull the material through the die. These controllable process parameters will be adjusted, as a function of the forming process, to ensure that there will be no slippage of the stock material relative to the dies. As a practical matter, the process variables cannot be predetermined and set because the coaction of each individual die with the stock material will be different. These differences, i.e., the process dependencies, can result in the stock material being damaged or destroyed by, for example, being over stressed or being advanced to one of the cascaded dies too rapidly.

As a consequence of the operating difficulty briefly discussed above, conventional prior practice has been to have skilled operating personnel exercise manual control over the process variables. A drawing process wherein such manual control is exercised is described in German Patent 27 49 505. It has also been proposed to employ semi-automatic control employing relatively costly apparatus with control rollers such as, for example, described in German Patent 1 072 216. An alternative automatic control, wherein contact rollers are employed to sense the operating conditions intermediate the individual dies, is described in published German Patent Application 30 09 779. A further prior art approach to the exercise of control over a multiple die drawing machine, wherein the force on the individual die holders is measured, is described in published German Patent Application 2 140 580. Finally, in the proposed control process described in published German Application 40 09 732, sensors comprising rollers which are in contact with the stock material are used during the set-up and are retracted during continuous operation.

All of the above-briefly described examples of prior art drawing machine control processes and apparatus share a common deficiency. Specifically, the productivity of the systems and the quality of the final product are highly dependent upon the experience and skill of the operating personnel. A further disadvantage of most of the prior art techniques which seek to obtain a degree of automation resides in the added cost and reduced system reliability incident to the use of contact rollers or other sensors which contact the stock material. The lack of reliability results from the inherent wear of the contact rollers. A further disadvantage incident to the use of contact rollers is that they necessarily reduce processing speed through tending to cause the stock material to be misaligned with the inlets of the drawing dies. Indeed, with some materials or sections, the added bending of the stock material resulting from the use of contact rollers can not be tolerated because of the deletorious effect on the quality of the end product.

To summarize, there has been a long standing desire in the art to exercise automatic control over a multiple die drawing machine that implements a direct, non-sliding or non-slip drawing process. The desired automatic control would exercise supervision over the individual drives associated with each drawing die to ensure that the load imposed on the stock material and its speed would be adjusted to values commensurate with the instantaneous material properties as well as to valves commensurate with conditions at the upstream and downstream dies. A control of the type long desired would determine the actual instantaneous parameters without the use of force measurement devices or other stock material contacting devices such as, for example, compensating rollers and contact rollers.

SUMMARY OF THE INVENTION

The present invention overcomes the above-briefly described and other deficiencies and disadvantages of the prior art by means of a novel control method which enables both the set-up and subsequent operation of a multiple die drawing machine to be accomplished automatically. In accordance with the invention, the signals commensurate with the variable process parameters, and particularly stock material speed and applied force, are preferably derived directly from the drives of each of the means which draws the stock material through a die. In the practice of the present invention, the speeds of the stock material at the individual drawing dies are automatically and continually adjusted in accordance with forming ratios, such automatic and continual adjustment being accomplished even when there are changes in the forming devices or drawing dies.

Also in accordance with the present invention, and by way of distinction with the prior art, the final drive in the material flow direction is not operated as a guide or constant-speed drive. Rather, the last drive is associated with a speed controller which generates a signal commensurate with a desired value for the system load. This desired value is employed as a desired load value for the control and regulating devices associated with each drive. Accordingly, the desired load value is always automatically and continually adjusted to the process-related circumstances such as, for example, the amount of draft and the strength of the stock material.

BRIEF DESCRIPTION OF THE DRAWING

The present invention may be better understood, and its numerous objects and advantages will become apparent to those skilled in the art, by reference to the accompanying drawing which is a schematic illustration of a control for a cascaded multiple die drawing machine in accordance with the invention.

DESCRIPTION OF THE DISCLOSED EMBODIMENT

With reference to the drawing, a wire drawing system or machine having a plurality of stations or stages is shown schematically. For purposes of explanation, the drawing machine is shown as having three stations which are respectively indicated at n, n-1 and n-2. Each of these drawing stations include a drawing unit 1, a drawing die 2, a braking device 6 and a brake control 5. The stock material being drawn to a final desired shape, a wire for example, is withdrawn from a supply reel, not shown, and serially pulled through the dies 2 by the associated drawing devices 6. The wire advances in the direction indicated by arrow and may pass around the drawing units one or more times in order to enable the desired force to be applied to the stock material without slippage.

Each of the drawing units 1 is driven by a drive 3 which will include an electrical drive motor. These drive motors may be alternating or direct current devices which are controllable in the conventional manner to vary rotational speed and output power, i.e., developed torque. Each of the drives 3 has its own controller 4 for generating the motor control signals. The drives 3 and associated controllers 4 may, for convenience be integrated into a single package.

In the practice of the disclosed embodiment of the present invention, the following signals are generated and utilized:

| Signal | Description |
|---|---|
| n.10 | Actual stock material speed |
| n.11 | Actual force applied to stock material (drawing station load) |
| n.12 | Desired drawing station stock material speed |
| n.13 | Desired stock material applied force |
| n.14 | Ratio n.13/n.11 |
| n.15 | Counter-tension correction value |
| n.16 | Ratio n.12/n.20 |
| n.20 | Drive speed command signal |
| n.21 | Synchronous control (braking command) |
| n.22 | Desired stock material speed (adjusted) |
| O.10 | Actual instantaneous stock material speed used for system control |
| O.13 | Desired system load (equals n.13) |
| O.22 | Desired system speed (equals n.12 for station n |
| Qv | Amount of draft |

The actual stock material feed velocity or speed signals n.10 and the actual load signals n.11 are derived from parameters which are measurable at each drawing unit 1 either by monitoring the operation of the drive 3 or the drum or the like which pulls the stock material through the die. Thus, the n.10 speed signals may, for example, be the rotational speed of the motor of drive 3 or the rotational speed of the drum of the drawing unit 1. These signals may either be direct current or alternating current depending on the type of drive. Similarly, the load signals n.11 may be in the form of measurements of developed torque or the power being consumed by the drive 3. The important point, of course, is that the same variable be measured at each drawing station and that all of the variables be converted, as necessary, into a system of values suitable for processing. For example, the controllers 4 and 9 may include analog to digital convertors for pre-processing the sensed operating parameters and digital to analog convertors for the generated command signals.

The disclosed system further includes a speed controller 9 which generates, in response to O.10 and O.22 signals, the O.13 desired system load value. This desired system load value is employed as the desired load value n.13 signal which is simultaneously delivered to each of the controllers 4.

The system desired speed value, i.e., the O.22 signal supplied as an input to signal generator 9, is provided by an integrator 11. This system desired speed value O.22 is also used as the speed reference signal n.12 delivered to the controller 4 of drawing station n. The desired speed value signal n.12 is serially assessed, and modified if necessary, while being passed from controller to controller. Thus the O.22 signal functions as the desired speed or rpm reference value of the cascade, i.e., the system speed value, and each of the cascaded controllers 4 outputs an n.22 desired speed value which is employed as the n.12 desired speed input for the next upstream drawing station which is operative. In the controller 4 associated with the last or most downstream operative drawing station, station n in the example being described, the O.22/n.12 signal is compared with a n.10 signal provided by the drawing unit 1/drive 3 of that station.

The control system also includes an automatic selection switch 10 to which the actual speed n.10 signals from each of the drawing stations are delivered. When the system is in partial operation, the switch 10 will pass, to signal generator 9 as the actual speed value O.10, the speed signal generated at the last, i.e., most downstream, of the drawing stations which is actually working the stock material. In the case of a drawing station which is not in operation, the desired speed value input signal n.12 will be fed back without modification, i.e., the n.22 output signal value from the controller of an inoperative drawing station will be equal to the n.12 desired speed signal applied at the input to the controller of that station.

The controllers 4 operate upon the actual and desired speed and load signals in accordance with process-dependent values and parameters. For example, there will be a predetermined ratio n.16 of the desired input signal value n.12 to the desired output signal value n.22 for each drive 3, these ratios being dependent on the Qv value, as well as the proportional gain, restoring and rate times for the controller 4. Presetting of the controllers with these process-dependent values and parameters is accomplished by means of an overall system controller 8, and the values and parameters may be varied during drawing by the system controller 8.

The system controller 8 is interfaced to the individual station controllers 4 by means of an "observer" 7. This interface device 7 constantly measures the process variables n.10 and n.11 and their desired or computed values n.20, n.12 and n.13 and continually calculates the corresponding process and system conditions. The device 7, in response to the measured process variables and values, and additional input information including changes in material strength, amount of drafts, (Qv actual value) and the material storage on the drawing disks, calculates the ratios or correction factors necessary to make the desired load value signal n.13 uniform n.14 with the actual load signal n.11. The device 7 also generates the counter-drawing or backpull correction value n.15 as well as corresponding corrections in the respective controllers 4 in order to follow up and control wear-related process parameters.

The controllers 4 cooperate with the system controller 8 to achieve synchronous control, via command signal n.21, of the actuators 5 for the brakes 6. This synchronous control adjusts the brakes for the load conditions, in accordance with a drawing program, when the system is started in dependency on the actual load n.11. The brakes 6 are also synchronously controlled during stopping of the system in dependency on the actual value of the command signals n.20.

While a preferred embodiment has been shown as described, various modifications and substitutions may be made thereto without departing from the spirit and scope of the invention. Accordingly, it is to be understood that the present invention has been described by way of illustration and not limitation.

What is claimed is:

1. A method for controlling a direct, non-slip wire drawing process, the process including subjecting elongated stock material to the action of a plurality n of serially arranged stationary drawing dies, each die being associated with a separate drawing means, said control method comprising the steps of:

determining the linear speed of the stock material in the vicinity of each die and generating a rotational speed signal (n.10) commensurate therewith, said speed signals being derived from an operating parameter of an associated means for drawing the stock material through the die;

determining the force applied to the stock material to pull it through each die and generating a force signal (n.11) commensurate therewith, said force signals being a function of an operating parameter of the associated means for drawing the stock material through each die;

generating a desired speed signal (n.12) commensurate with the desired stock material linear speed upon exit from the last die;

generating a desired force signal (n.13) commensurate with the desired force to be applied to the stock material; and independently controlling the operation of the drawing means as a function of the actual speed signal (n.10) and desired speed signal (n.12) and actual force signal (n.11) and desired force signal (n.13) wherein the operation of the drawing means for the most downstream die which is operating on the stock material is controlled as a function of the actual speed of the stock material exiting that die and the desired speed signal (n.12) and wherein the desired stock material linear speed signal for the next operative die in the upstream direction comprises the desired adjusted system speed signal (n.22) modified by a factor commensurate with any correction in linear speed implemented at the most downstream die and by a factor commensurate with any correction in force implemented at the most downstream die.

2. The method of claim 1 wherein each drawing means has a drive and further comprising generating a drive speed command signal (n.20) for the drive of each drawing means and further comprising controlling the ratio of the value of the desired input speed signal (n.12) and the value of the output drive speed command signal (n.20) for the drive of each drawing means to achieve an equivalence between the value of the desired force signal (n.13) and the value of the actual force signal (n.11).

3. The method of claim 1 wherein each drawing means has a drive and comprising adjusting the drive for each drawing means by equating the desired force signal (n.13) value for each drawing means with the actual force signal (n.11) value.

4. The method of claim 1 wherein each drawing means has a drive and a controller further comprising generating a desired system force signal (O.13) value, which is simultaneously the desired force signal (n.13) value for all the drawing means, from the desired output value of a speed controller, which obtains its desired system speed value (O.22) from a value integrator (11), which serves at the same time as a desired speed signal (n.12) value for the nth controller (4) as a desired speed value signal in cascade, wherein the actual system speed value (O.10) for the speed controller (9) is the actual speed signal (n.10) value of the nth drive (3).

5. The method of claim 4 wherein when the system is partially operating, the actual system speed signal (O.10) for the speed controller turns on the actual stock material speed signal (n.10) for the actual speed value via a corresponding selection switch on the last drawing means that works in the direction of the material flow, and the corresponding desired drawing station input speed signal (n.12) on the drawing means not in operation is forwarded unaffected to the desired stock speed adjusted output signal (n.22).

6. The method of claim 1 wherein each drawing means has a controller and a drive, and the desired drawing station input speed signal (n.12) for the drawing means is forwarded unchanged as the drive speed command signal (n.20) to the control of the associated drive (3).

7. The method of claim 1 further comprising presetting process-dependent values and parameters which affect each drawing means selected from the group consisting of the ratio (n.16), which is dependent on the amount of draft (Qv value), of the desired speed signal (n.12) value to the desired drive speed command signal (n.20) value for the drawing means, the proportional gain, the restoring and rate times for the drawing means.

8. The method of claim 1 further comprising providing backpull correction values and constantly monitoring the drawing process while constantly measuring process variables selected from the group consisting of the actual speed (n.10), the actual forces (n.11), the desired stock material force (n.13) and the drive speed command signal (n.20) and, depending on the process and system conditions, continually calculating changes in material strength, and amount of draft (Qv actual value), and according to the drawing process, scaling the ratios (n.14) of the desired value of the force signal (n.13) to the value of the actual force signal (n.11) and the backpull correction values (n.15).

9. The method of claim 1 wherein each drawing means has a controller, a brake control and a braking device and further comprising generating a synchronous control signal (n.21) from the controllers to the brake controls (5) for activating the braking devices (6) on each of the drawing means.

10. A method for controlling a direct, non-slip wire drawing process, the process including subjecting elongated stock material to the action of a plurality n of serially arranged stationary drawing dies, each die being associated with a separate drawing means having a drive, said control method comprising the steps of:

determining the linear speed of the stock material in the vicinity of each die and generating a rotational speed signal (n.10) commensurate therewith, said speed signals being derived from an operating parameter of an associated means for drawing the stock material through the die;

determining the force applied to the stock material to pull it through each die and generating a force signal (n.11) commensurate therewith, said force signals being a function of an operating parameter of the associated means for drawing the stock material through each die;

generating a desired speed signal (n.12) commensurate with the desired stock material linear speed upon exit from the last die;

generating a desired force signal (n.13) commensurate with the desired force to be applied to the stock material;

generating a drive speed command signal (n.20) for the drive of each drawing means; and independently controlling the operation of the drawing means as a function of the actual speed signal (n.10) and desired speed signal (n.12) and actual force signal (n.11) and desired force signal (n.13) wherein the ratios of the value of the desired input speed signal (n.12) and the value of the output drive speed command signal (n.20) for the drive of each drawing means and the desired value of the system adjusted output speed signal (n.22) for a subsequent drive is controlled to achieve an equivalence between the value of the desired force signal (n.13) and the value of the actual force signal (n.11).

11. The method of claim 10 comprising adjusting the drive for each drawing means by equating the desired force signal (n.13) value for each drawing means with the actual force signal (n.11) value.

12. The method of claim 10 wherein each drive has a controller and further comprising generating a desired system force signal (O.13) value, which is simultaneously the desired force signal (n.13) value for all the drawing means, from the desired output value of a speed controller, which obtains its desired system speed value (O.22) from a value integrator (11), which serves at the same time as a desired speed signal (n.12) value for the nth controller (4) as a desired speed value signal in cascade, wherein the actual system speed value (O.10) for the speed controller (9) is the actual speed signal (n.10) value of the nth drive (3).

13. The method of claim 12 wherein when the system is partially operating, the actual system speed signal (O.10) for the speed controller turns on the actual stock material speed signal (n.10) for the actual speed value via a corresponding selection switch on the last drawing means that works in the direction of the material flow, and the corresponding desired drawing station input speed signal (n.12) on the drawing means not in operation is forwarded unaffected to the desired stock speed adjusted output signal (n.22).

14. The method of claim 10 wherein each drawing means has a controller, and in the direction of movement of the stock material, the desired drawing station input speed signal (n.12) for the first drawing means is forwarded unchanged as the drive speed command signal (n.20) to the controller of the next upstream operative drawing means.

15. A method for controlling a direct, non-slip wire drawing process, the process including subjecting elongated stock material to the action of a plurality n of serially arranged stationary drawing dies, each die being associated with a separate drawing means having a controller and a drive, said control method comprising the steps of:

determining the linear speed of the stock material in the vicinity of each die and generating a rotational speed signal (n.10) commensurate therewith, said speed signals being derived from an operating parameter of an associated means for drawing the stock material through the die;

determining the force applied to the stock material to pull it through each die and generating a force signal (n.11) commensurate therewith, said force signals being a function of an operating parameter of the associated means for drawing the stock material through each die;

generating a desired speed signal (n.12) commensurate with the desired stock material linear speed upon exit from the last die;

generating a desired force signal (n.13) commensurate with the desired force to be applied to the stock material; and independently controlling the operation of the drawing means as a function of the actual speed signal (n.10) and desired speed signal (n.12) and actual force signal (n.11) and desired force signal (n.13); and generating a desired system force signal (O.13) value, which is simultaneously the desired force signal (n.13) value for all the drawing means, from the desired output value of a speed controller, which obtains its desired system speed value (O.22) from a value integrator (11), which serves at the same time as a desired speed signal (n.12) value for the nth controller (4) as a desired speed value signal in cascade, wherein the actual system speed value (O.10) for the speed controller (9) is the actual speed signal (n.10) value of the nth drive (3).

16. The method of claim 15 wherein when the system is partially operating, the actual system speed signal (O.10) for the speed controller turns on the actual stock material speed signal (n.10) for the actual speed value via a corresponding selection switch on the last drawing means that works in the direction of the material flow, and the corresponding desired drawing station input speed signal (n.12) on the drawing means not in operation is forwarded unaffected to the desired stock speed adjusted output signal (n.22).

17. The method of claim 15 wherein in the direction of movement of the stock material, the desired drawing station input speed signal (n.12) for the first drawing means is forwarded unchanged as the drive speed command signal (n.20) to the control of the next upstream operative drawing means.

18. The method of claim 15 further comprising presetting process-dependent values and parameters which affect each drawing means selected from the group consisting of the ratio (n.16) of the desired speed signal (n.12) value to the desired drive speed command signal (n.20) value for the drawing means, the proportional gain, the restoring and rate times for the drawing means and the amount of draft (Qv).

19. The method of claim 15 wherein each drawing means has a brake control and a braking device and further comprising generating a synchronous control signal (n.21) from the controllers to the brake controls (5) for activating the braking devices (6) on each of the drawing means.

* * * * *